US007338024B2

(12) United States Patent
Chen et al.

(10) Patent No.: US 7,338,024 B2
(45) Date of Patent: Mar. 4, 2008

(54) PADDING PROTECTIVE ARRANGEMENT FOR FURNITURE

(76) Inventors: Jeffrey M. Chen, 2872 Woodlawn Ave., San Marino, CA (US) 91108; Christine Shanhua Tung, 2872 Woodlawn Ave., San Marino, CA (US) 91108

( * ) Notice: Subject to any disclaimer, the term of this patent is extended or adjusted under 35 U.S.C. 154(b) by 54 days.

(21) Appl. No.: 11/256,336

(22) Filed: Oct. 22, 2005

(65) Prior Publication Data

US 2007/0090259 A1 Apr. 26, 2007

(51) Int. Cl.
*A47B 95/00* (2006.01)

(52) U.S. Cl. ..... 248/345.1; 293/128

(58) Field of Classification Search ..... 248/345.1; 293/128

See application file for complete search history.

(56) References Cited

U.S. PATENT DOCUMENTS 4,153,230 A * 5/1979 Giacin ..... 248/345.1
4,370,373 A * 1/1983 Janicz ..... 428/151
4,726,614 A * 2/1988 Myers et al. ..... 293/128
4,865,015 A * 9/1989 Hasty et al. ..... 126/500
5,184,857 A * 2/1993 Hawkins ..... 293/128
5,809,901 A * 9/1998 Gutzmer ..... 108/27
5,975,599 A * 11/1999 Goldstein ..... 293/128
6,186,564 B1 * 2/2001 Ashcroft ..... 293/128
6,708,941 B1 * 3/2004 Bowen et al. ..... 248/345.1

* cited by examiner

*Primary Examiner*—Anita M. King
(74) *Attorney, Agent, or Firm*—Raymond Y. Chan; David and Raymond Patent Firm

(57) ABSTRACT

A padding protective arrangement for furniture includes an elastic connective member and a plurality of cushioning pads. The elastic connective member has first and second end connecting portions, and a connector provided on the first end connecting portions. Each of the cushioning pads has a thickness larger than that of the elastic connective member, and a through mounting slot formed on the cushioning pad, wherein the elastic connective member is arranged to penetrate the cushioning pads at the respective mounting slot in such a manner that the first and the second end connecting portions are detachably connecting with each other by the connector to define a cushioning loop within the elastic connective member and the cushioning pads, wherein the cushioning loop is arranged to fittedly encircle a rim portion of the furniture for providing a cushion effect to absorb shock when a user accidentally hits the rim of the furniture.

13 Claims, 3 Drawing Sheets

PADDING PROTECTIVE ARRANGEMENT FOR FURNITURE

BACKGROUND OF THE PRESENT INVENTION

1. Field of Invention

The present invention relates to a cushioning device, and more particularly to a padding protective arrangement which is capable of encircling on a rim of furniture for providing a cushioning effect for preventing injury when a user accidentally hits that furniture.

2. Description of Related Arts

Conventional furniture, such as a conventional table, usually comprises a rim which is capable of causing severe injury when people, especially children, accidentally hit it. As a matter of fact, some parents may enclose the rim of the furniture by something which possesses certain amount of cushioning effect in order to prevent their children from being injured by the furniture. For example, some parents may enclose the furniture's rim by some sorts of plastic bands for softening the hardness of the rim in order to prevent their children from being accidentally injured.

On the other hand, some furniture manufacturers try to resolve this problem by filleting any sharp edges or corners present on their furniture so as to minimize the chance of causing accidents. Moreover, filleting any sharp corners or edges may enhance the sales of the relevant furniture because customers may after all prefer to buy furniture which is safer to their family members, especially children.

A major problem for the above-mentioned strategies in reducing the risk of accidental injury is that they may not be effective or desirable. For example, while enclosing the furniture's rim may actually reduce some risk of accidental injury, children may nevertheless get injured when hitting on the rim. On the other hand, enclosing the furniture's rim with plastic band may severely undermine the overall aesthetic effect of the furniture so that it may simply not be desirable, especially when the furniture is expensive and famous for its design. Therefore, in this scenario, there exists a tension between preserving furniture's design and reducing the risk of accidental injury.

With regards to the second practice (filleting of furniture's rim), it will not only increase the manufacturing cost of the furniture, but also limit the number of design which may be incorporated into the furniture because only filleted edges or corners are allowed. What is the most important point to raise here however, is that filleting the edges and corners of the relevant furniture does not necessarily has the effect of reducing the risk of accidental injury where children carelessly hit those edges or corners. In fact, those filleted edges and corners are still made of rigid (or even very hard) materials which may still be possible to inflict grievous bodily harm to people, especially children.

SUMMARY OF THE PRESENT INVENTION

A main object of the present invention is to provide a padding protective arrangement for furniture which is capable of encircling on a rim of the furniture for providing a cushioning effect so as to prevent injury when a user accidentally hits that furniture.

Another object of the present invention is to provide a padding protective arrangement for furniture which comprises a plurality of cushioning pads spacedly encircling a rim of the furniture so as to constitute a physical non-destructive buffer between the furniture rim and the users of the present invention. In other words, the present invention substantially prevents the user from contacting the rim so as to substantially prevent accidental injury inflicted by sharp rim or edges of the furniture.

Another object of the present invention is to provide a padding protective arrangement for furniture which is capable of detachably and adjustably attaching on a wide variety of furniture so that the present invention is adapted for widespread applications.

Another object of the present invention is to provide a padding protective arrangement for furniture which does not involve complicated mechanical components so as to minimize the manufacturing cost as well as the ultimate selling price of the present invention.

Another object of the present invention is to provide a padding protective arrangement which does affect the original design and shape of the furniture so as not to jeopardize overall aesthetic appeal of the furniture. In other words, the present invention can be conveniently attached on the furniture to enhance children's safety, yet it may be conveniently detached for allowing aesthetic features of the furniture to be shown.

Another object of the present invention is to provide a padding protective arrangement for furniture which is easy to assemble and disassemble.

Accordingly, in order to accomplish the above objects, the present invention provides a padding protective arrangement for furniture, comprising:

an elastic connective member having first and second end connecting portions, and a connector provided on said first end connecting portion; and a plurality of cushioning pads each having a thickness larger than that of the elastic connective member, and a through mounting slot formed on the cushioning pad, wherein the elastic connective member is arranged to penetrate the cushioning pads at the respective mounting slot in such a manner that the first and the second end connecting portions are detachably connecting with each other by the connector to define a cushioning loop within the elastic connective member, wherein the cushioning loop is arranged to fittedly encircle a rim portion of the furniture such that the cushioning pads are capable of providing a cushion effect to absorb shock when a user accidentally hits the rim of the furniture.

These and other objectives, features, and advantages of the present invention will become apparent from the following detailed description, the accompanying drawings, and the appended claims.

DETAILED DESCRIPTION OF THE PREFERRED EMBODIMENT

Figure 1:
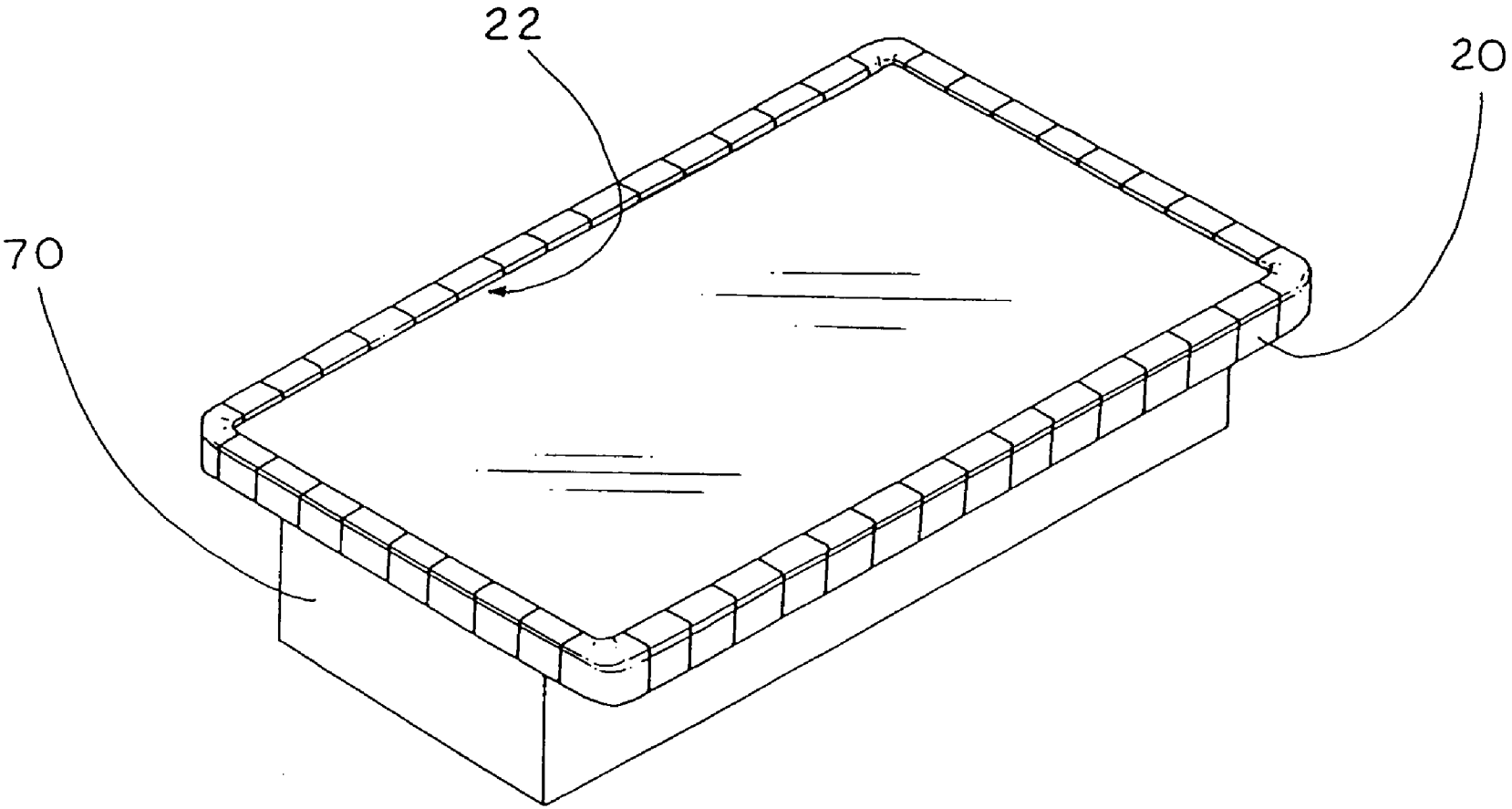
FIG. 1 is a perspective view of a padding protective arrangement for furniture according to a preferred embodiment of the present invention.
Figure 2:
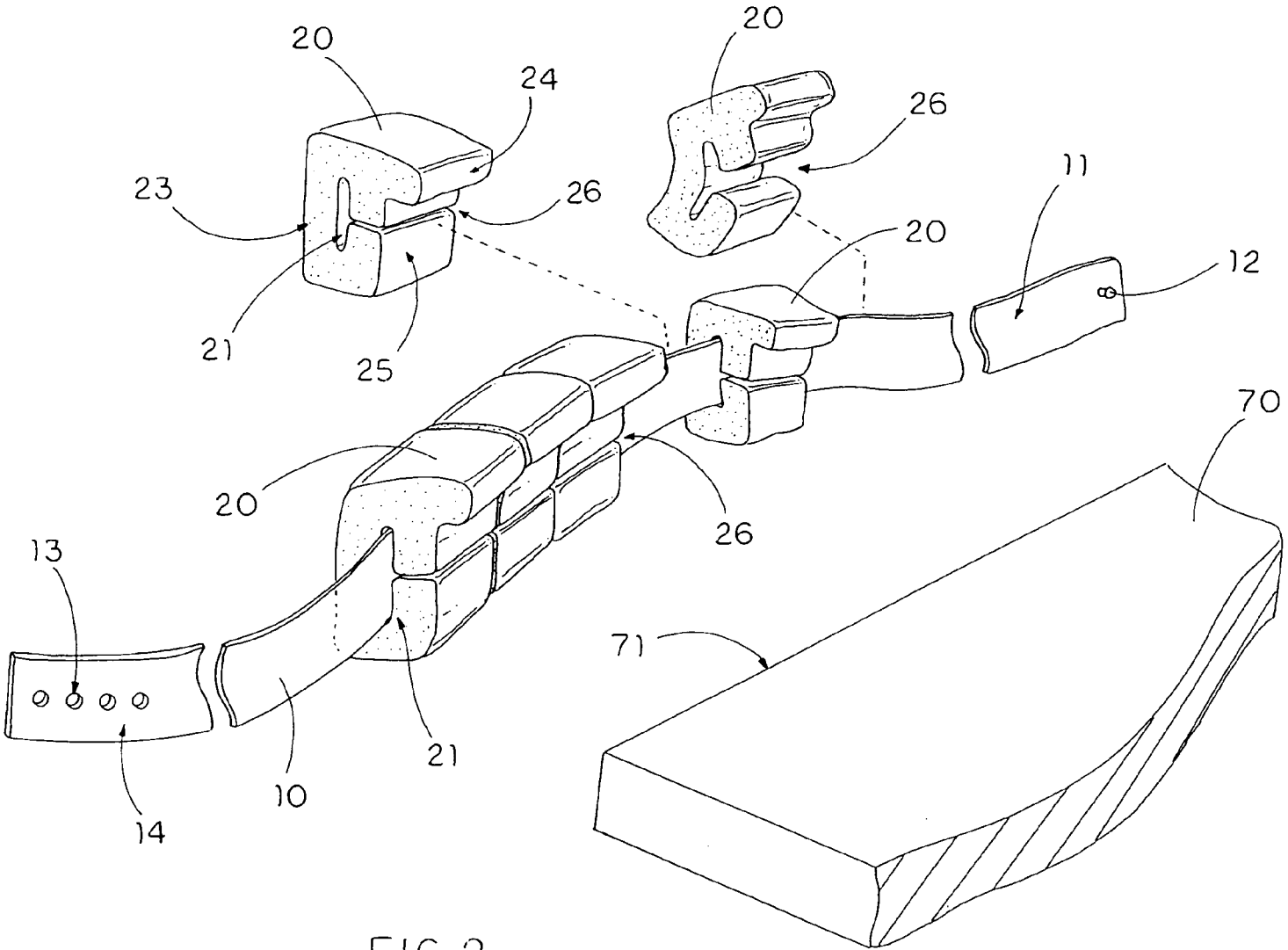
FIG. 2 is an exploded perspective view of the padding protective arrangement for furniture according to the above preferred embodiment of the present invention.
Figure 3:
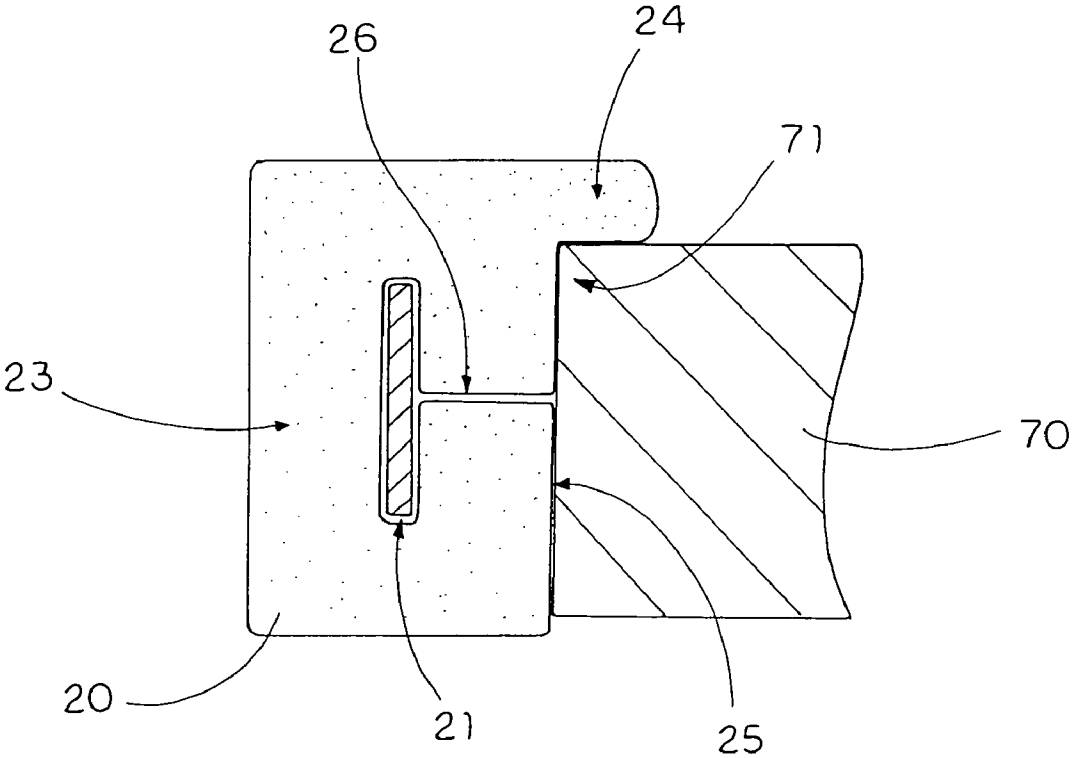
FIG. 3 is a side view of the padding protective arrangement for furniture according to the above preferred embodiment of the present invention.

Referring to FIG. 1 to FIG. 3 of the drawings, a padding protective arrangement for furniture 70 according to a preferred embodiment of the present invention is illustrated, in which the padding protective arrangement comprises an elastic connective member 10 and a plurality of cushioning pads 20.

The elastic connective member 10 has first and second end connecting portions 11, 14, and a connector 12 provided on the first end connecting portion 11.

Each of the plurality of cushioning pads 20 has a thickness larger than that of the elastic connective member 10, and a through mounting slot 21 formed on the cushioning pad 20, wherein the elastic connective member 10 is arranged to penetrate the cushioning pads 20 at the respective mounting slot 21 in such a manner that the two end connecting portions are detachably connecting with each other by the connector 12 to define a cushioning loop 22 within the elastic connective member 10, wherein the cushioning loop 22 is arranged to fittedly encircle a rim portion 71 of the furniture 70 such that the cushioning pads 20 are capable of providing a cushion effect to absorb shock when a user accidentally hits the rim 71 of the furniture 70.

The present invention is provided for a wide variety of furniture 70, such as a table, which usually has at least one rim constituted by a plurality of sharp peripheral edges and/or corners. For example, a typical tabletop usually has four peripheral sharp edges and a corresponding number of sharp corners.

The elastic connective member 10 is preferably embodied as being made of plastic materials and is capable of being stretched to form the cushioning loop 22 for enclosing the rim 71 of the furniture 70, and automatically restored to its original shape when the stretching force is relieved. According to the preferred embodiment of the present invention, the elastic connective member 10 is flattened in shape so that it can be conveniently stored and easily attached on the rim 71 of the furniture 70.

In order to detachably connect the two end connecting portions 11 with each other for forming the cushioning loop 22, the elastic connective member 10 has a plurality of connecting holes 13 spacedly formed on the second end connecting portion 14 wherein the connector 12 provided on the first end connecting portion 11 is arranged to selectively couple with one of the connecting holes 13 formed on the second end connecting portion 14 for forming the cushioning loop 22. In other words, the user is able to selectively couple with one of the connecting holes 13 for adjustably forming the cushioning loop 22 having an optimal size fitted to the furniture 70 in question.

Each of the cushioning pads 20 is preferably made of elastic materials having predetermined shock resistance ability for absorbing impact when a user hits the furniture 70. Alternatively, the cushioning pads 20 may also be made of foaming materials having comparable characteristics in absorbing shock.

Referring to FIG. 3 of the drawings, each of the cushioning pads 20 has a main cushioning portion 23 and a top holding portion 24 integrally and outwardly extended from the top of the main cushioning portion 23 to define a L-shaped inner engaging surface 25 by an bottom surface of the top holding portion 24 and a corresponding side surface of the main cushioning portion 23, wherein the inner engaging surface 25 is arranged to fittedly bias against the rim 71 of the furniture 70 for optimally absorbing shock when the user accidentally hit the furniture 70.

As a result, the through mounting slot 21 is formed on the main cushioning portion 23 wherein the elastic connective member 10 is arrange to pass through each of the mounting slots 21 and connect the first and second end connecting portions 11, 14 for forming the cushioning loop 22.

In order to further facilitate easy attachment and detachment of the cushioning pads 20 to and from the elastic connective member 10, each of the cushioning pads 20 further has a transverse channel 26 transversely formed on the main cushioning portion 23 and communicated with the corresponding mounting slot 21, in such a manner that the cushioning pad 20 is adapted to be slightly deformed for allowing the elastic connective member 10 to penetrate the transverse channel 26 and receive into the mounting slot 21. Consequently, the cushioning pads 20 are allowed to selectively attach on and detach from the elastic connective member 10 via the transverse channel 26.

Therefore, the user is able to selective the optimal number of cushioning pads 20 for his particular furniture 70 and attach the corresponding cushioning pads 20 on the elastic connective member 10.

The operation of the present invention is as follows: the user simply needs to couple an optimal number of cushioning pads 20 on the elastic connective member 10 and encircle it along the rim 71 of the furniture 70. After that, the user simply needs to connect the first end connecting portion 11 with the second end connecting portion 14 for forming the cushioning loop 22. The cushioning pads 20 will form a buffer for absorbing impact when someone accidentally hit the furniture's rim 71, and since the majority of impact is absorbed, the risk of injury will be minimized. Indeed, it is difficult to conceive that a person would be hurt by, say, foaming materials. When the user desires that the padding protective arrangement should not in use, he can simply detach all the cushioning pads 20 from the elastic connective member 10, and detach the elastic connective member 10 from the furniture 70. As such, the original aesthetic appearance of the furniture 70 will not be affected by the present invention.

From the forgoing descriptions, it can be shown that the above objects have been substantially accomplished. The present invention effective provides a padding protective arrangement for furniture which is capable of encircling on a rim 71 of the furniture 70 for providing a cushioning effect so as to prevent injury when a user accidentally hits that furniture.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A padding protective arrangement for furniture, comprising:

an elastic connective member having first and second end connecting portions, a connector provided on said first end connecting portions, and a plurality of connecting holes spacedly formed on said second end connecting portion; and a plurality of cushioning pads each having a thickness larger than that of said elastic connective member, and a through mounting slot formed on said cushioning pad, wherein said elastic connective member is arranged to penetrate said cushioning pads at said respective mounting slot in such a manner that said first and said second end connecting portions are detachably connecting with each other by said connector to define a cushioning loop within said elastic connective member and said cushioning pads, wherein said cushioning loop is arranged to fittedly encircle a rim portion of said furniture such that said cushioning pads are capable of providing a cushion effect to absorb shock when a user accidentally hits said rim of said furniture, wherein said connector provided on said first end connecting portion is arranged to selectively couple with one of said connecting holes on the second end connecting portion when said elastic connective member is bent to form said cushioning loop.

2. The padding protective arrangement, as recited in claim 1, wherein each of said cushioning pads has a main cushioning portion and a top holding portion integrally and outwardly extended from a top side of said main cushioning portion to define a L-shaped inner engaging surface by an bottom surface of said top holding portion and a corresponding side surface of said main cushioning portion, wherein said inner engaging surface is arranged to fittedly bias against said rim of said furniture for optimally absorbing shock when said user hits said furniture.

3. The padding protective arrangement, as recited in claim 1, wherein each of said cushioning pads further has a transverse channel transversely formed thereon to communicate with said corresponding mounting slot, in such a manner that said cushioning pad is adapted to be slightly deformed for allowing said elastic connective member to penetrate said transverse channel and receive into said mounting slot for detachably attaching on said elastic connective member.

4. The padding protective arrangement, as recited in claim 2, wherein each of said cushioning pads further has a transverse channel transversely formed on said main cushioning portion and communicated with said corresponding mounting slot formed on said main cushioning portion of said corresponding cushioning pad, in such a manner that said cushioning pad is adapted to be slightly deformed for allowing said elastic connective member to penetrate said transverse channel and receive into said mounting slot for detachably attaching on said elastic connective member.

5. The padding protective arrangement, as recited in claim 1, wherein said elastic connective member is made of plastic materials and is capable of being stretched to form said cushioning loop for enclosing said rim of said furniture, and automatically restored to its original shape when said stretching force is relieved.

6. The padding protective arrangement, as recited in claim 3, wherein said elastic connective member is made of plastic materials and is capable of being stretched to form said cushioning loop for enclosing said rim of said furniture, and automatically restored to its original shape when said stretching force is relieved.

7. The padding protective arrangement, as recited in claim 4, wherein said elastic connective member is made of plastic materials and is capable of being stretched to form said cushioning loop for enclosing said rim of said furniture, and automatically restored to its original shape when said stretching force is relieved.

8. The padding protective arrangement, as recited in claim 1, wherein each of said cushioning pads is made of elastic materials having predetermined shock resistance ability for absorbing impact when a user hits said furniture.

9. The padding protective arrangement, as recited in claim 3, wherein each of said cushioning pads is made of elastic materials having predetermined shock resistance ability for absorbing impact when a user hits said furniture.

10. The padding protective arrangement, as recited in claim 4, wherein each of said cushioning pads is made of elastic materials having predetermined shock resistance ability for absorbing impact when a user hits said furniture.

11. The padding protective arrangement, as recited in claim 1, wherein each of said cushioning pads is made of foaming materials having predetermined shock resistance ability for absorbing impact when a user hits said furniture.

12. The padding protective arrangement, as recited in claim 3, wherein each of said cushioning pads is made of foaming materials having predetermined shock resistance ability for absorbing impact when a user hits said furniture.

13. The padding protective arrangement, as recited in claim 4, wherein each of said cushioning pads is made of foaming materials having predetermined shock resistance ability for absorbing impact when a user hits said furniture.

* * * * *